US005551544A

United States Patent [19]

Draghetti

[11] Patent Number: 5,551,544

[45] Date of Patent: Sep. 3, 1996

[54] CIGARETTE FILTER ASSEMBLY MACHINE

[75] Inventor: Fiorenzo Draghetti, Medicina, Italy

[73] Assignee: G.D Societá per Azioni, Bologna, Italy

[21] Appl. No.: 375,345

[22] Filed: Jan. 19, 1995

[30] Foreign Application Priority Data

Jan. 20, 1994 [IT] Italy ..... BO94A0013

[51] Int. Cl.[6] ..... B65G 47/24

[52] U.S. Cl. ..... 198/404; 198/450; 198/951

[58] Field of Search ..... 198/404, 410, 198/951, 450

[56] References Cited

U.S. PATENT DOCUMENTS

| | | | |
|---|---|---|---|
| 2,919,012 | 12/1959 | Dearsley | 198/951 X |
| 2,923,397 | 2/1960 | Parrish | 198/404 |
| 2,988,198 | 6/1961 | Pinkham | 198/404 |
| 3,151,728 | 10/1964 | Schmermund | 198/404 |
| 3,215,250 | 11/1965 | Schubert | 198/404 X |
| 3,472,355 | 10/1969 | Menge | 198/450 X |
| 3,625,103 | 12/1971 | Giatti | 198/951 X |
| 4,664,249 | 5/1987 | Gherardi | 198/951 X |
| 5,105,833 | 4/1992 | Mattei et al. | 131/281 |

FOREIGN PATENT DOCUMENTS

| | | | |
|---|---|---|---|
| 1091019 | 10/1960 | Germany | 198/951 |
| 934791 | 5/1960 | United Kingdom | 198/951 |
| 1022835 | 3/1966 | United Kingdom . | |
| 2241866 | 9/1991 | United Kingdom . | |

*Primary Examiner*—D. Glenn Dayoan

*Attorney, Agent, or Firm*—Marshall, O'Toole, Gerstein, Murray & Borun

[57] ABSTRACT

A cigarette filter assembly machine having a first and second succession of side by side, oppositely oriented single cigarettes are fed to a turnover unit wherein, with respect to their original position, the cigarettes in the first succession are turned 180° on to the opposite side of the cigarettes in the second succession to form two successions of equioriented, transversely spaced cigarettes which are fed to an output combining roller along respective spatially distinct paths, one of which is defined, at least partly, by two conical rollers with respective axes parallel to each other.

6 Claims, 1 Drawing Sheet

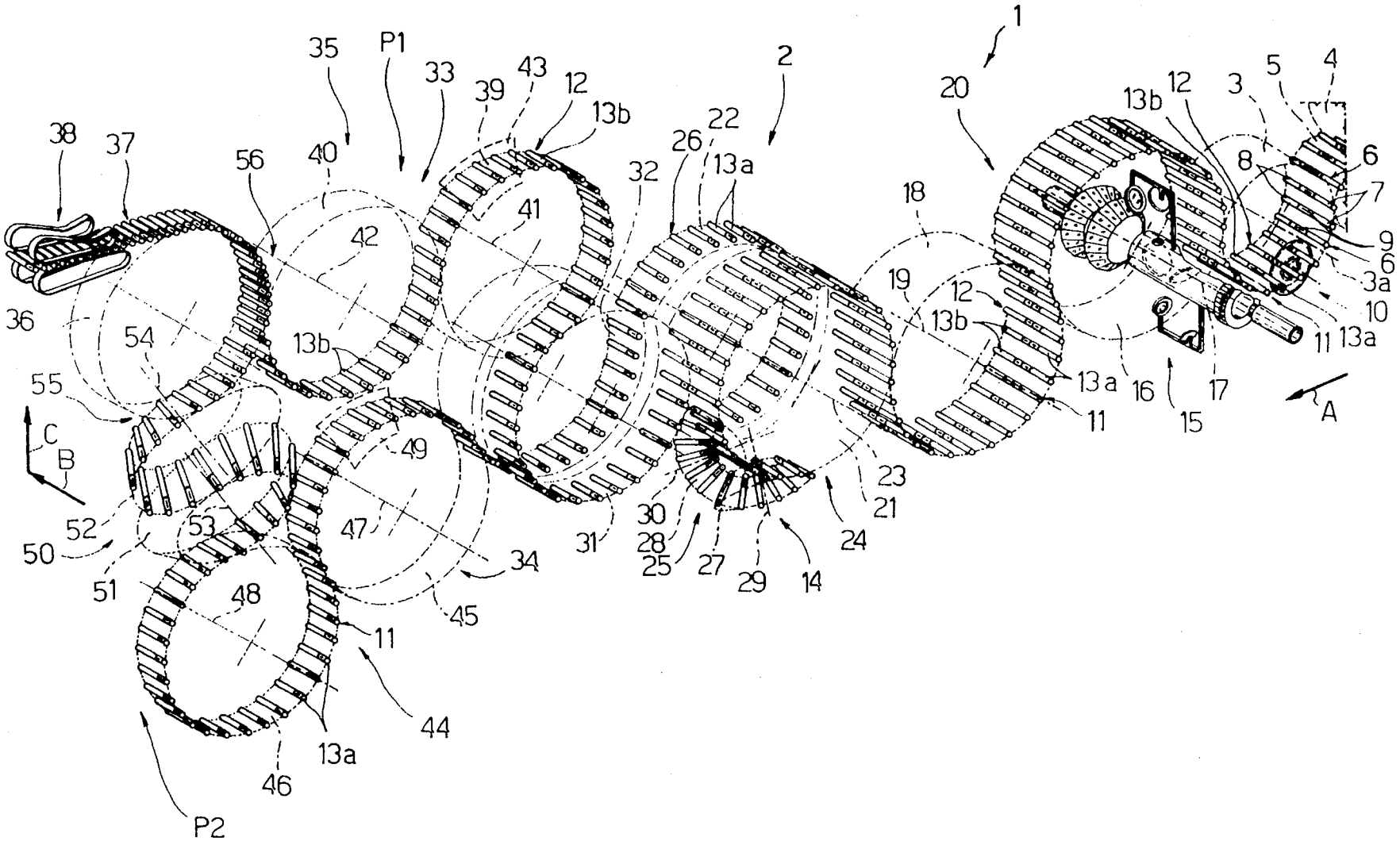
1
2
3
4
5
6
7
8
9
10
11
12
13a
13b
14
15
16
17
18
19
20
21
22
23
24
25
26
27
28
29
30
31
32
33
34
35
36
37
38
39
40
41
42
43
44
45
46
47
48
49
50
51
52
53
54
55
56
P1
P2
A
B
C

CIGARETTE FILTER ASSEMBLY MACHINE

BACKGROUND OF THE INVENTION

The present invention relates to a cigarette filter assembly machine.

As described, for example, in British Patent No. 2,241,866, filter-tipped cigarettes are produced on a filter assembly machine, along a first portion of which, each cigarette portion in a first succession of equally spaced cigarette portions is connected, at a rolling station and by means of a connecting element of sheet material, to a corresponding portion in a second succession of cigarette portions to form a tobacco item hereinafter referred to as a "double cigarette". Each double cigarette consists of two cigarette portions separated by a double filter made integral with the two cigarette portions by said connecting element, the central portion of which encloses the double filter, and the end portions of which each enclose one end of a respective cigarette portion.

According to the above British patent, once formed, the double cigarettes are fed successively through a cutting station where they are cut transversely in half to form two successions of oppositely oriented single cigarettes. That is, downstream from the cutting station, the cigarettes in each pair of single cigarettes formed by cutting a respective double cigarette are arranged with their filters facing and substantially contacting each other.

According to the above British patent, the two successions of single cigarettes are then fed to a turnover station where each single cigarette in one succession is turned over and fed into the space between two adjacent single cigarettes in the other succession to form a single succession of equioriented single cigarettes, which are fed to the output of the filter assembly machine and from there to the input of a packing machine.

On known filter assembly machines of the above type, the single cigarettes are normally quality controlled by devices normally associated with the single succession of equioriented single cigarettes, and which provide for determining correct filling and surface finish of the single cigarettes, and for rejecting any not conforming to given standards.

Due to the high output capacity of modern filter assembly machines and the speed at which the single cigarettes are fed through the machine, the above quality control devices are seldom capable of correctly checking all the single cigarettes. One known solution to the problem is to provide control devices for both successions of single cigarettes prior to the turnover operation, or at any rate before the two successions of single cigarettes formed by cutting the double cigarettes are combined into a single succession of equioriented single cigarettes.

On known machines featuring a quality control device for each of the two successions of single cigarettes formed by cutting the double cigarettes, the control devices are superimposed in relation to the operator, thus making them difficult to inspect and maintain.

SUMMARY OF THE INVENTION

It is an object of the present invention to provide a filter assembly machine designed to enable direct access by the operator to the quality control devices, and which provides for relatively troublefree, low-cost maintenance and repair.

According to the present invention, there is provided a cigarette filter assembly machine comprising first conveyor means for supplying a first and second succession of side by side, oppositely oriented cigarettes; turnover means for receiving said first and second successions, turning over the cigarettes in the first succession so that they face the same way as the cigarettes in the second succession, and so forming two successions of equioriented, transversely spaced cigarettes; output combining means for combining said two successions into a single final succession of equioriented cigarettes; and second conveyor means for transferring said two successions from the turnover means to the combining means; characterized in that said second conveyor means comprise two distinct conveyor lines, each relative to a respective said succession; the two conveyor lines extending along two distinct paths spatially offset both in a first direction crosswise to the paths, and in a second direction crosswise to the first direction; and a first of said lines comprising a portion extending obliquely in relation to said two directions and preferably defined, at least partly, by two conical rollers with parallel axes.

BRIEF DESCRIPTION OF THE DRAWING

The present invention will be described with reference to the accompanying drawing which shows a schematic view in perspective of a non-limiting embodiment, with parts removed for clarity.

DETAILED DESCRIPTION OF THE INVENTION

Number 1 in the accompanying drawing indicates a filter assembly machine presenting an output portion 2 comprising a first roller 3 which is supplied by two transfer rollers 4 and 5 with a succession of double cigarettes 6, each comprising two cigarette portions 7 and 8 connected by a double filter 9. Roller 3 rotates clockwise (in the drawing) about a horizontal axis 3*a* parallel to the longitudinal axis of double cigarettes 6, and provides for feeding double cigarettes 6 in a direction A crosswise to axis 3*a* and through a known cutting station 10 where double cigarettes 6 are cut in half to form two successions 11 and 12 of single cigarettes 13—respectively indicated 13*a* and 13*b* —arranged side by side and oppositely oriented, i.e. with their filters facing and substantially contacting each other.

Successions 11 and 12 are transferred from roller 3 to a turnover unit 14 via a perforating unit 15 substantially of the type described in U.S. Pat. No. 5,105,833, to which full reference is made herein in the interest of full disclosure, and which provides for forming ventilation holes (not shown) through the filters of cigarettes 13.

Perforating unit 15 comprises a roller 16 rotating anticlockwise (in the drawing) about an axis 17 parallel to axis 3*a*, and which provides for receiving successions 11 and 12 from roller 3 and transferring them to a roller 18 rotating clockwise (in the drawing) about an axis 19 parallel to axis 17, and which forms the output roller of a conveyor device 20 for feeding successions 11 and 12 to turnover unit 14.

Turnover unit 14 comprises two side by side rollers 21 and 22, of which roller 21 is positioned tangent to roller 18 and is substantially twice as long as roller 22. Roller 21 rotates anticlockwise (in the drawing) about an axis 23 parallel to axis 19, and presents a number of suction seats (not shown) equally spaced about its outer periphery, and each of which provides for receiving and retaining two oppositely oriented cigarettes 13*a* and 13*b* arranged facing and contacting each other.

Roller 22 is connected integral and coaxially with roller 21 on the same side as succession 12, and presents a number of peripheral suction seats (not shown), each extending in line and coaxial with a corresponding seat (not shown) on roller 21, and each of which provides for receiving and retaining a respective cigarette 13*a* with its filter parallel to and coaxial with a corresponding cigarette 13*b* housed in the corresponding seat (not shown) on roller 21. As they travel about roller 21, cigarettes 13*a* in succession 11 are fed to a pickup station 24 where they are removed successively by a conical-roller turnover assembly 25 forming part of unit 14, and are turned 180° into the seats (not shown) on roller 22. Each cigarette 13*a* in succession 11 is thus turned over on to the opposite side of succession 12 to form a succession 26 of cigarettes 13*a* aligned with and equioriented in relation to corresponding cigarettes 13*b*.

In the example shown, assembly 25 comprises two conical rollers 27 and 28 with respective axes 29 and 30 perpendicular to each other and coplanar with each other and with axis 23. Roller 27 rotates clockwise (in the drawing) about axis 29, and is tangent to roller 21 at station 24 wherein the contacting generating lines of rollers 21 and 27 are parallel to axis 23 and lie in a vertical plane containing axes 23 and 29.

Roller 28 rotates about axis 30, and is tangent to roller 27 at a transfer station wherein the contacting generating lines of rollers 27 and 28 are perpendicular to axis 23 and coplanar with said vertical plane containing axes 23 and 29. Roller 28 is also tangent to roller 22 at an unloading station wherein the contacting generating lines of rollers 28 and 22 are aligned with the contacting generating lines of rollers 21 and 27 in station 24, and also lie in said vertical plane containing axes 23, 29 and 30.

At the output of unit 14, successions 12 and 26 are transferred from rollers 21 and 22 to respective side by side, integral rollers 31 and 32 respectively tangent to rollers 21 and 22, and which form the input rollers of respective lines 33 and 34 of a conveyor device 35 for feeding respective successions 12 and 26 to a combining roller 36 coplanar with roller 31 and which provides for receiving successions 12 and 26, combining them into a single succession 37 of equioriented cigarettes 13, and feeding succession 37 to the output conveyor 38 of machine 1.

Line 33 comprises two conveyor rollers 39 and 40 tangent to each other, coplanar with rollers 31 and 36, and rotating about respective axes 41 and 42 parallel to each other and to axis 23. Roller 39 is located over and tangent to roller 31, and provides for feeding cigarettes 13*b* into engagement with known test devices 43 for successively testing the permeability and/or condition and/or ventilation of cigarettes 13*b* and, if necessary, rejecting them at a known reject station (not shown) along the periphery of roller 40 between rollers 39 and 36.

Line 34 comprises an input portion 44 defined by two conveyor rollers 45 and 46 tangent to each other, coplanar with roller 32, and rotating about respective axes 47 and 48 parallel to each other and to axis 23. Roller 45 is located to the side of and substantially on a level with roller 32, is tangent to roller 32, and provides for feeding cigarettes 13*a* into engagement with known test devices 49 for successively testing the permeability and/or condition and/or ventilation of cigarettes 13*a* and, if necessary, rejecting them at a known reject station (not shown) along the periphery of roller 46 which is located substantially beneath roller 36 and, together with roller 45, is offset in relation to roller 36 in a direction B parallel to axis 23.

Line 34 also comprises an output portion 50 extending obliquely upwards in a substantially vertical plane, connecting the output of input portion 44 to combining roller 36, and defined by two oppositely conical rollers 51 and 52 rotating about respective axes 53 and 54 parallel to each other. According to a variation not shown, rollers 51 and 52 are separated by one or more pairs of cylindrical rollers. In the embodiment shown, however, rollers 51 and 52 are tangent to each other, and are respectively tangent to rollers 46 and 36 at an unloading station 55 wherein cigarettes 13*a* are unloaded on to roller 36, and which is located upstream, in relation to the rotation direction of roller 36, from an unloading station 56 wherein cigarettes 13*b* are unloaded on to roller 36.

Operation of machine 1 as described above is self-explanatory. One point to note, however, is the manner in which lines 33 and 34 define two paths P1 and P2 which, at least as regards line 33 and input portion 44 of line 34, are offset in relation to each other both in direction B and in a substantially vertical direction C perpendicular to direction B, thus eliminating any overlapping of rollers 39, 40 and rollers 45, 46 from the standpoint of the operator stationed in front of machine 1, and so making test devices 43 and 49 directly accessible from the outside for maintenance, repair and/or part replacements.

I claim:

1. A cigarette filter assembly machine (1) comprising first conveyor means (20) for supplying a first (11) and second (12) succession of side by side, oppositely oriented cigarettes (13); turnover means (14) for receiving said first (11) and second (12) successions, turning over the cigarettes (13*a*) in the first succession (11) so that they face the same way as the cigarettes (13*b*) in the second succession (12), and so forming two successions (12, 26) of equioriented, transversely spaced cigarettes; output combining means (36) for combining said two successions (12, 26) into a single final succession (37) of equioriented cigarettes (13); and second conveyor means (35) for transferring said two successions (12, 26) from the turnover means (14) to the combining means (36); characterized in that said second conveyor means (35) comprise two distinct conveyor lines (33, 34), each relative to a respective said succession (12; 26); the two conveyor lines (33, 34) extending along two distinct paths (P1, P2) spatially offset both in a first direction (B) crosswise to the paths (P1, P2), and in a second direction (C) crosswise to the first direction (B); and a first (34) of said lines (33, 34) comprising a portion (50) extending obliquely in relation to said two directions (B, C).

2. A machine as claimed in claim 1, characterized in that said oblique portion (50) is defined, at least partly, by two conical rollers (51, 52).

3. A machine as claimed in claim 2, characterized in that said two conical rollers (51, 52) are oppositely conical and present respective axes (53, 54) parallel to each other.

4. A machine as claimed in claim 3, characterized in that said two conical rollers (51, 52) are tangent to each other.

5. A machine as claimed in claim 1, characterized in that said oblique portion (50) forms the output portion of said first line (34), which also comprises an input portion (44) substantially parallel to a second (33) of said lines (33, 34) and spatially offset in said two directions (B, C) in relation to the second line (33).

6. A machine as claimed in claim 5, characterized in that the second line (33) and said input portion (44) of the first line (34) comprise respective means (43, 49) for determining the physical characteristics of the cigarettes (13).

* * * * *